United States Patent [19]

Ootani et al.

[11] 4,194,946

[45] Mar. 25, 1980

[54] PROCESS FOR CONTINUOUSLY PREPARING FIBER REINFORCED CEMENT

[75] Inventors: Toshihiro Ootani, Osaka; Mikio Kozuka; Ryuichiro Takeda, both of Yokohama; Hideaki Kurihara, Kawasaki, all of Japan

[73] Assignees: Asahi Glass Company, Ltd., Tokyo; Nakashima Manufacturing Company, Ltd., Osaka, both of Japan

[21] Appl. No.: 837,223

[22] Filed: Sep. 27, 1977

[30] Foreign Application Priority Data

Oct. 28, 1976 [JP] Japan ..... 51/128804

[51] Int. Cl.[2] ..... D21F 11/04

[52] U.S. Cl. ..... 162/156; 162/209; 162/210; 162/212; 162/217; 162/299; 162/364; 210/77

[58] Field of Search ..... 162/128, 154, 156, 185, 162/186, 210, 217, 219, 227, 299, 314, 346, 348, 364, 396, 209, 212; 210/77, 216, 401; 264/87, 91

[56] References Cited

U.S. PATENT DOCUMENTS

| | | | |
|---|---|---|---|
| 2,156,311 | 5/1939 | Schuh | 162/154 |
| 2,592,518 | 4/1952 | Magnani | 162/314 X |
| 2,688,406 | 9/1954 | Holland | 210/77 X |
| 2,737,858 | 3/1956 | Simpson | 162/299 X |
| 3,974,024 | 8/1976 | Yano et al. | 162/156 X |
| 3,979,254 | 9/1976 | McIntyre | 162/299 |

FOREIGN PATENT DOCUMENTS

| | | |
|---|---|---|
| 4661728 | 4/1973 | Japan . |
| 51-31619 | 9/1976 | Japan . |
| 1378695 | 12/1974 | United Kingdom . |

*Primary Examiner*—Richard V. Fisher

*Attorney, Agent, or Firm*—Oblon, Fisher, Spivak, McClelland & Maier

[57] ABSTRACT

Fiber reinforced cement is continuously prepared by forming a conveyor by connecting a plurality of suction boxes each having a perforated plate, contacting the perforated plates of the suction boxes with a filter cloth and moving the suction boxes with the filter cloth at a synchronous speed, feeding a cementitious slurry and a fiber on the filter cloth, removing excess water by suction from the cementitious slurry through a suction trough connected to a suction device, and releasing the suction on the suction boxes to separate the filter cloth from the perforated plates of the suction boxes.

9 Claims, 3 Drawing Figures

PROCESS FOR CONTINUOUSLY PREPARING FIBER REINFORCED CEMENT

BACKGROUND OF THE INVENTION

1. Field of the Invention

The present invention relates to a process for continuously preparing a fiber reinforced cement (hereinafter referred to as FRC) and an apparatus for preparing the same.

2. Description of the Prior Art

Sheet forming methods such as the Hatchek method, and the Magniani method have been mainly employed for preparing asbestos cement slates and pulp cement boards useful in the preparation of FRC.

The direct spraying method and the spray-suction method have been employed for preparing glass fiber reinforced cement hereinafter referred to as GRC) sheets.

Because in the preparation of fiber reinforced cement a dewatering step is used by the application of suction, a dense sheet having high strength can be obtained and the sheets can be used in various fields.

Continuous spray-suction methods and sheet forming methods have been proposed as processes for continuously preparing GRC sheet in U.S. Pat. No. 3,974,024 and other patents. However, the processes have not been employed on an industrial scale except certain sheet forming methods. The belt filtering apparatus using suction boxes has been disclosed in Japanese Patent Publication No. 31619/1976.

In accordance with the conventional sheet forming method of preparing the GRC sheet, the glass fibers may have a directional orientation in the GRC sheet so that the sheet has different directional strength characteristics and the strength of this type of GRC sheet is relatively less than the strength of GRC sheets prepared by the direct spraying method or the spray-suction method. A process is required for continuously preparing GRC sheets having as high a strength as GRC sheets prepared by the direct spraying method and the spray-suction method. In order to achieve such a continuous process, it has been proposed to move a filter cloth on a suction box. However, when a reduced pressure is maintained in the suction box, the filter cloth of flexible material is sucked on the suction box such that it is not easily removed. Moreover, the cloth readily twists or becomes creased if forcibly removed from the suction box which can damage or tear the GRC sheet on the cloth. Accordingly, the continuous process has not been employed in industrial process.

SUMMARY OF THE INVENTION

It is an object of the present invention is to provide a process for continuously preparing FRC having high strength without damage to the product with high productivity.

It is another object of the present invention to provide an apparatus for preparing FRC having high strength at high productivity.

The foregoing and other objects of the present invention have been attained by forming a conveyor by connecting a plurality of suction boxes each having a perforated plate, contacting a filter cloth on the perforated plates of the suction boxes to move the suction boxes with the filter cloth at a synchronous velocity, feeding a cementitious slurry and a fiber on the filter cloth, sucking excess water from the cementitious slurry through a suction trough connected to a suction device, and releasing the suction on the suction boxes to separate the filter cloth from the perforated plates of the suction boxes.

It is also an object of the present invention to provide an apparatus for preparing an FRC which comprises a conveyor formed by connecting a plurality of suction boxes each having a perforated plate, a suction trough which is disposed at a rear part of the suction boxes and which is connected to a suction box; a filter cloth which is contacted with the perforated plates of the suction boxes above the suction trough and which is moved at a synchronous velocity with the suction boxes and a cementitious slurry feeder and a fiber feeder.

DETAILED DESCRIPTION OF THE PREFERRED EMBODIMENTS

Figure 1:
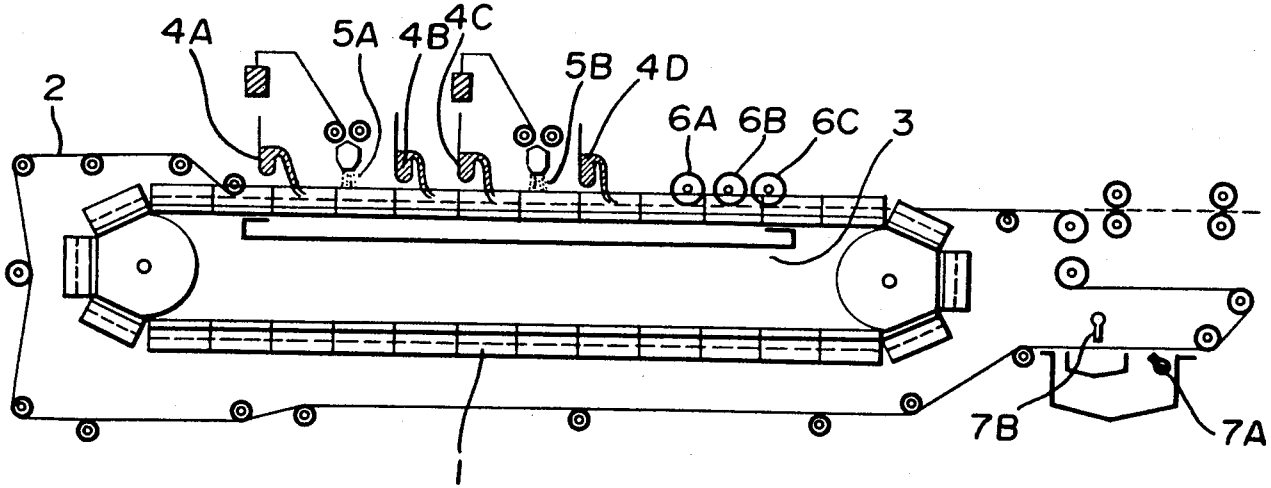
FIG. 1 is a schematic view of one embodiment of an apparatus for continuously preparing the FRC sheet according to the present invention.

The advantageous feature of the present invention is that an FRC sheet having high density and high strength can be easily prepared by a continuous process which removes water from the FRC by suction in high productivity.

The other advantageous feature of the present invention is that the pattern of a wire net is not formed on the surface of the FRC sheet because the FRC sheet is prepared on the filter cloth and the FRC sheet can be easily separated from the suction boxes by the filter cloth. It can be also easily separated from the filter cloth because of the flexibility of the filter cloth and damage such as cracking can be prevented at the time the FRC sheet is separated. The FRC sheet can be separated at an early stage in the process so that it can be conveniently press-shaped and surface processed after the separation.

The other advantageous feature of the present invention is that the suction on the suction box and the suction on the filter cloth are simultaneously released at a specific position whereby the water washing operation and the water draining operation can be conducted down stream of the specific position in a manner similar to the batch system.

The other advantageous feature of the present invention is that the FRC sheet prepared by the process has a strength higher than that of the FRC sheet prepared by the conventional sheet forming method and it has no directional strength difference. It is not easily peeled even though various kinds of cementitious slurry and various kinds of fiber can be used and an aggregate can be incorporated in the cement which cannot be done in the conventional sheet forming method.

Moreover, it is possible to prepare a long FRC sheet such that it has a length of more than 10 m in one apparatus when the space for the line is enough.

In accordance with the present invention, a GRC sheet having high strength can be obtained by using glass fiber as the reinforcing fiber and the strength is remarkably higher than the sheets formed by the conventional sheet forming method and is similar to that of the GRC sheet prepared by the direct spray method. A continuous operation cannot be attained by the direct spray method.

In the process of the present invention, a continuous filter cloth is used whereby the seams of the joints of the suction boxes are not significantly impressed in the surface of the FRC and a long FRC sheet having a flat surface can be obtained.

When the cementitious slurry and the fiber are separately fed from the different feeders and they are mixed as they are fed to the filter cloth or on the filter cloth, the filamentization of the fiber caused by premixing can be prevented and the glass fiber can be incorporated at higher content so as to obtain the FRC sheet having higher strength. The strength of the FRC sheet can be remarkably increased and a uniform FRC sheet can be prepared in high productivity by combining the feeding method with the special suction method to dewater the sheet.

The suction boxes which are not deformed are used and a press means such as a roller press can be applied to the FRC material during or after the suction process so as to easily provide a smooth surface for the FRC sheet without any problems. If a belt conveyor such as a rubber belt were used when the FRC is pressed deformation of the conveyor results.

Moreover, in accordance with the present invention, suction can be attained at only a desired zone because the suction is performed through a suction trough. It is possible to attain intermittent dewatering and a hose which directly connects the suction boxes to a vacuum pump is not necessary. Accordingly, the apparatus can be a large size and the maintenance of the apparatus is easy from the viewpoint of structure.

The cementitious slurry used in the present invention can be a slurry of a cementitious composition or a slurry of mixture of a cementitious composition and a fiber.

The cementitious composition can be a mixture of a hydraulic inorganic cement such as Portland cement, alumina cement, Roman cement, magnesia cement, gypsum, lime etc. with an aggregate such as sand, stone, pearlite, wood chip, foamed resin beads, vermiculite, rubber grain and others and other additives such as a latex, a polymer etc.

The fiber can be an inorganic fiber such as asbestos, glass fiber, steel fiber or a synthetic fiber such as polypropylene fiber, nylon fiber, acryl fiber or a natural organic fiber such as cotton, sisal or jute. It is especially preferable to use the glass fiber so as to provide high strength.

The concentration of solid components in the cementitious slurry is usually in a range of about 5 to 60% when it is used in the flow spreading method, the concentration depending upon the cementitious composition and the apparatus.

It is preferable to use a pulp slurry in order to form a smooth surface, to prevent splitting of the layers of the cementitious sheet, and to attain sufficient separation of water from the cementitious composition and the fiber on the filter cloth. When only a pulp slurry is used, it is preferably fed at a ratio of water to pulp of about 3 to 30. When the pulp slurry is composed with the cementitious composition, the amount of water is increased slightly over the amount of water in a cementitious slurry having no pulp.

Referring to the drawings, the apparatus of the present invention will be described.

FIG. 1 is a schematic view of one embodiment of an apparatus of the present invention. Suction boxes (1) each having a perforated surface are connected to form a conveyor. A filter cloth (2) which is moved with the suction boxes at a synchronous velocity is contacted with the suction boxes of the conveyor.

A suction trough (3) is formed in suitable zone in contact with the filter cloth on the conveyor whereby suction to dewater the deposited cement material is attained through the filter cloth, the suction boxes and the suction trough (3).

Figure 2:
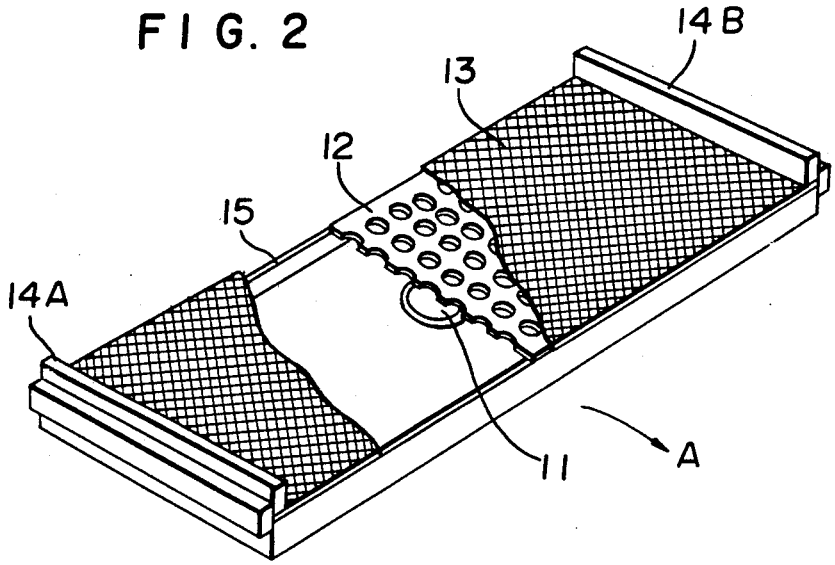
FIG. 2 is a partially broken schematic view of a suction box used in the present invention.

FIG. 2 is a partial broken schematic view of the suction box of FIG. 1. A suction hole (11) is formed in the rear, although it can be at a side part with the exception of the perforated plate. A perforated plate (12) and a wire net (13) are disposed at the front surface and side wall plates (14A), (14B) for confining the width of the FRC sheet are disposed on both sides of the suction box (15).

Figure 3:
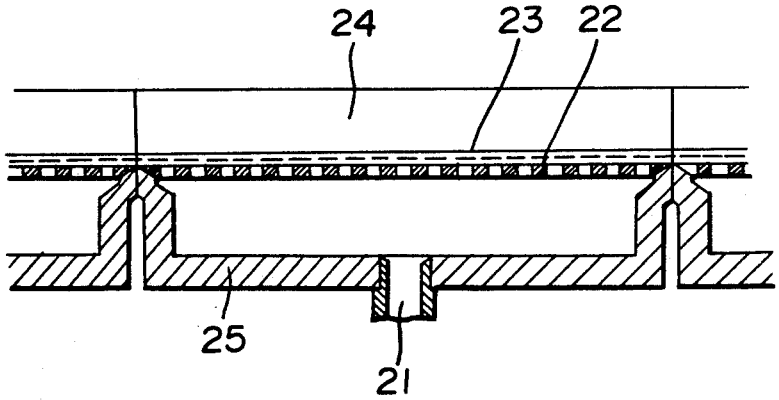
FIG. 3 is a sectional view of the suction box used in the present invention.

FIG. 3 is a partially enlarged sectional view of the suction box (25) which has suction hole (21), perforated plate (22), wire net (23) and side wall plates (24).

The suction box is a preferable embodiment in the present invention.

The shape of the suction box such as the shape of the perforated plate and the wire net, the size of the holes, percentage of voids, the shape of surface of the perforated plate, the position of the suction hole, the length and width of the suction box and the height of the side wall plates, the wheels for movement and the joints etc. are selected as desired depending upon the size of the apparatus, the kind of the FRC sheet etc. The suction box has the perforated surface in contact with the filter cloth to hold the filter cloth on which the cementitious slurry and the fiber are fed and dewatered by drawing water through the filter cloth by suction.

The side wall plates of the suction box are used for confining the width of the green sheet of the FRC. The decrease of the thickness of the green sheet which results from the flow of cementitious slurry in the transverse direction is prevented. The side wall plates can be also used as means for holding the filter cloth.

The filter cloth can be a conventional filter cloth and is moved with the suction boxes at a synchronous velocity and it should be of a mesh size which substantially prevents the passage of the cementitious slurry and the fiber and it is selected depending upon the particles of the cement, the size of the aggregate and the length and diameter of the fiber.

However, the velocity of the movement of the filter cloth should be synchronized to the velocity of the movement of the suction boxes. When it is not synchronized, creases on waves in the filter cloth are formed whereby cause creases or twists in the FRC sheet.

The suction trough is connected to the suction hole of the suction box in the bottom and the suction pump. Suction is simultaneously applied to the suction box and the filter cloth. The suction trough is in contact with the bottom portion of the suction box so that the suction hole is exposed to the trough and air tightness is maintained about each suction hole.

In particular, the suction trough can be a trough having a U-shaped sectional view the width of which is substantially the same as the outer diameter of the suction hole. The opening of the suction trough is contacted with the bottom of the suction box and is in communication with the suction hole but is in close contact with the bottom to prevent air leakage.

It is possible to use only one suction trough to provide uniform suction. It is also possible to divide the suction trough so as to provide intermittent suction and/or to provide different suctional forces, if necessary.

The suction trough is disposed in the zone in which the filter cloth is in contact with the suction boxes so that the suction holes of the suction boxes are open to the trough.

It is also possible to place a part of the suction trough at the part of the apparatus where the filter cloth detaches from the suction box as the means for closely contacting the filter cloth to with the suction box. When intermittent suction is applied and/or the degree of suction is varied, it is possible to form a zone in which the filter cloth and the suction boxes which move at synchronous speed and which includes the spot where the filter cloth separates from the suction boxes are not subjected to suction.

The degree of suction in the suction box is usually in a range of about −50 to −380 mmHg. and it can be decided depending upon the kinds of the FRC sheet desired and the suction time.

The suction time is usually in a range of about 10 to 1200 seconds. When the cementitious slurry is fed in a matter such that a laminated product is formed, the suction time is usually in a range of about 2 to 240 seconds.

The cementitious slurry is flow spread at (4A) onto the filter cloth on the conveyor formed by connecting the suction boxes and then the chopped strands of cut glass fiber roving are spread onto the deposited slurry at (5A). This is followed by the sequential application of cementitious slurry at (4B) and (4C) and chopped strands of fiber at (5B) followed by cementitious slurry at (4D).

When the slurry and fibers are applied, the cementitious slurry and the fiber can be fed by various methods. As described above, it is possible to feed them such that a laminate of layers is formed by separately feeding the materials or the materials can be mixed together as they all applied to the filter cloth. Two or more kinds of the cementitious slurry and two or more kinds of the fiber can be fed onto the cloth at different positions.

The thickness of the FRC sheet is usually thin. When a fiber having high rigidity such as glass fiber is used, filaments of the fiber are nappy on the surface. This adversely affects the appearance and the strength of the product, and the handling of the same. Accordingly, it is preferable to feed them as follows. The cementitious slurry not containing glass fiber is first fed or a thin film of pulp etc. is formed on the surface of the filter cloth to retain the cementitious slurry, and then, the glass fiber or a mixture of the glass fiber and the cementitious slurry is applied at the same time or after the cementitious slurry is applied.

The ratio of water to the solid components in the cementitious slurry is preferably about 0.67 to 20:1.0 in the case of the flow spreading method, about 0.15 to 1.0:1.0 in the case of the spraying method. When the pulp is incorporated, the ratio of water is preferably higher.

During the time the cementitious slurry and the fiber are applied, suction is constantly applied to the suction boxes or they are intermittently subjected to suction whereby the cementitious particles and the fibers are firmly contacted.

When suction on the slurry is discontinued thus providing intermittent suction, the applied slurry spread across the width of the boxes and is confined by the side wall plates and then the slurry is subjected to suction to dewater the same whereby a FRC sheet having a uniform thickness can be easily obtained.

When the width of the cementitious slurry feeder is substantially the same as the width of the suction box, an FRC sheet having a constant thickness can be easily obtained by continuous suction.

The cementitious slurry feeder can be a spray type feeder such as a gun type, roller type, or flow spreading type feeder. It is especially preferable to use the roller type spraying feeder or the spreading type feeder having wide width.

The fiber feeder is preferably a chopper having a wide width when a continuous fiber such as glass fiber is used. It is also possible to use the fiber feeder from which the fibers fall by force of gravity or a device can be used in which air is used to move the fiber from the storage vessel. The feeders can be selected as desired.

When the fiber feeder is disposed adjacent to the cementitious slurry feeder whereby the cementitious slurry and the fiber are mixed in the way of feeding them, for example, the roller type spraying feeder and the roller type chopped strand cutter are used to mix them by spray mixing, the fiber is easily and uniformly mixed with the cementitious slurry.

When the cementitious slurry and the fiber are sequentially fed, they can be uniformly mixed by beating the mixture after feeding them before removing water by suction such as beating the fiber and the cementitious slurry with a perforated plate such as a wire net.

When the cementitious slurry and the fiber are separately fed from the different feeders and they are mixed in the way of feeding them or on the filter cloth, especially they are mixed on the filter cloth, it is preferable to beat the mixture before removing water by suction, whereby the fiber is uniformly mixed with the cementitious slurry and the damage of the fiber can be prevented and the content of the fiber can be selected in a wide range in comparison with the method of premixing before feeding them. Consequently, the FRC sheet having high strength can be easily obtained.

The FRC sheet having high uniformity in transversal direction can be obtained by the combination of the roller spray type or flow spreading type cementitious slurry feeder having a wide width and the fiber feeder having a wide width such as a wide width chopper so as to feed them without traversing the feeders in transversal direction.

When suitable amount of pulp is incorporated in the cementitious slurry, especially the cementitious slurry near the surface layer, the split of layers is prevented and the surface condition is improved. The incorporation of pulp is especially preferable in the case of using the glass fiber as the fiber whereby the GRC sheet having high strength and no nap of the fiber can be advantageously obtained.

The laminate product of the cementitious slurry and the fiber is sucked for dewatering whereby the cement particles and the fiber are firmly contacted by the suction.

The surface of the green sheet is smoothed and pressed by the press rollers (6A), (6B), (6C) and then the suction is released as the suction box moves from the zone of the suction trough in which the boxes are subjected to suction whereby the filter cloth separates from the suction boxes and continues to move while supporting the green sheet of the FRC. Thereafter the green sheet of the FRC is separated from the filter cloth and is cut to the desired length. The cut green sheets are then cured.

It is preferable to press the FRC by the press rollers while under suction to dewater the FRC whereby excess water oozes from the FRC sheet and water is also moved on the front and rear surfaces to soften the surfaces of the FRC sheet so that the surface property of the FRC sheet does not deteriorate.

It is preferable to use a plurality of press rollers to sequentially increase the degree of pressure so that the green sheet of FRC can be both smoothed and compressed in order to obtain an FRC sheet having high strength.

The pressure in the pressing operation is preferably in a range of 0.5 to 50 kg/cm and especially in a range of 5 to 50 kg/cm at the final stage.

When a desired embossed pattern is formed on the press roller, the desired embossed pattern can be formed on the green sheet of the FRC and surface processing can be achieved at the same time.

The green sheet of the FRC having smooth surface without any deterioration can be continuously taken out instantly to obtain the green sheet of the FRC in high productivity by departing the filter cloth from the suction boxes which are not in the condition of suction by releasing the suction.

When separating the filter cloth from the suction box, it is possible to feed raise compressed air into the suction box through the suction trough to raise the filter cloth.

The time from the feeding to the separation depends upon the kind of the green sheet of the FRC. When the Portland cement and the glass fiber are combined, it is about 2 to 30 minutes. However, the strength of the green sheet is not high and accordingly, it is necessary to take care to maintain the shape of the sheet after the separation.

The filter cloth is washed with water (7A), (7B) after separating the green sheet of the FRC if necessary, and it is returned to the preparation step repeatedly. The filter cloth need not always be endless because the filter cloth can be uncoiled from a roll of filter cloth and recoiled on a take-up roll. However, an endless filter cloth is preferably used for the preparation of the FRC sheet in high productivity.

The resulting green sheet of the FRC can be further processed by a pressing, coloring, punching, drilling or laminating step and a curing or heat curing step etc.

The continuous process of the present invention will be further illustrated by certain examples.

EXAMPLE 1

The apparatus of FIG. 1 having a length for the suction trough of 6 m was used and the filter cloth and the suction boxes were moved at a rate of 2 m/min. The cementitious slurry and the fiber were fed as follows.

| | |
|---|---|
| (1) Cementitious slurry A containing pulp (pulp/Portland cement = 2 wt. %/98 wt. % solid content = 17 wt. %) | 5.9 Kg/m$^2$ |
| (2) Fiber (alkali resistant glass fiber chopped strand having a length of 37 mm) | 211 g/m$^2$ |
| (3) Cementitious slurry B (Portland cement water/cement = 150%) | 8.1 Kg/m$^2$ |
| (4) Fiber (the same with (2)) | 211 g/m$^2$ |
| (5) Cementitious slurry B (the same with (3)) | 8.1 Kg/m$^2$ |
| (6) Fiber (the same with (2)) | 211 g/m$^2$ |

-continued

| | |
|---|---|
| (7) Cementitious slurry B (the same with (3)) | 8.1 Kg/m$^2$ |
| (8) Cementitious slurry C (pulp/Portland cement 1 wt. %/99 wt. % solid content = 30 wt. %) | 4.3 Kg/m$^2$ |

The first layer was formed by feeding composition (1) and subjecting the deposited slurry to suction to dewater the deposited material and the second layer was formed by feeding compositions (2) and (3) while beating the deposited material and then removing water by suction. The third layer was formed by feeding compositions (4) and (5) and then beating the deposited slurry before complete dewatering and applying suction and then, the fourth layer was similarly formed by feeding compositions (6) and (7) and then applying suction. Suction was continuously applied at about −100 mmHg for 180 seconds (for 60 seconds after feeding the cementitious slurry C). In the final part of the step, the mixed slurry was pressed by four rollers under pressures of 10 kg/cm and then 30 kg/cm and then, the filter cloth was separated from the suction boxes. Thereafter the green GRC sheet was removed the filter cloth and it was cured on a flat plate at room temperature under high humidity for 28 days.

The resulting GRC sheet had a thickness of 6.3 mm, a bulk density of about 2.0 g/cm$^3$, a bending strength 358 kg/cm$^2$, and an impact strength of 15.6 kg.cm/cm$^2$(Izod type testing method). The sheet had a strength similar to the strength of a GRC sheet prepared by the direct spray method. Splitting of the layers of the GRC sheet was not observed.

EXAMPLE 2

The apparatus of FIG. 1 (the same with Example 1) was used and the filter cloth and the suction boxes were moved at a rate of 2 m/min. A roller type direct spray means consisting of a roller type sprayer and a roller type chopped strand cutter was used. A cementitious slurry having the following composition was sprayed at a rate of 24 kg/min. (solid content) by a roller type sprayer (noncompressed air) having a width of 1 m and chopped fiber strands having a length of 35 mm (Cem-Fil manufactured by Pilkington Brothers Limited) were fed at a rate of 1.2 kg/min. by the roller type chopped strand cutter so that the fiber and slurry were mixed during the spraying operation.

| Cementitious slurry composition | |
|---|---|
| Rapid-hardening Portland cement | 100 wt.parts |
| Sand | 50 wt.parts |
| Water reducing agent | 1 wt.parts |
| Water | 33 wt.parts |

The mixed slurry was subjected to reduced pressure of −200 mmHg for 120 seconds and it was pressed between two rollers each having diameter of 350 mm under pressures of 5 Kg/cm and 10 Kg/cm. Thereafter, the filter cloth was separated from the suction boxes and then, the green GRC sheet was separated from the filter cloth. The sheet was cured on a flat plate at room temperature under high humidity for 28 days.

The resulting GRC sheet had a thickness of 6.0 mm, a bulk density of 2.1 g/cm$^3$, a bending strength of 382 Kg/cm$^2$, and an impact strength of 15.5 Kg.cm/cm$^2$ (Izod test) which is a strength superior to the strength of a GRC sheet prepared by the direct spray method.

In accordance with the present invention, an FRC sheet of high strength, especially a GRC sheet can be continuously prepared in high productivity. The products can be used for various applications.

What is claimed is:

1. A process for continuously preparing a fiber reinforced cement, which comprises: forming a conveyer by connecting a plurality of suction boxes each having a perforated plate and each equipped with side wall members projecting above said perforated plate and continuously moving said conveyor; continuously moving a filter cloth at a synchronous speed with said conveyor into contact with said perforated plates immediately before a cementitious slurry is deposited on said filter cloth; sequentially and continuously feeding said cementitious slurry having a solids content of 5 to 60% at at least two positions onto said filter cloth and glass fiber at at least one position onto said filter cloth; uniformly mixing the deposited material by beating the material after it has been fed onto the filter cloth thereby forming a green, laminated sheet of cementitious material; confining the width of the deposited sheet by the side wall members of each suction box; removing excess water from said deposited sheet by applying suction to said suction boxes by a suction trough connected to a suction device; releasing the suction on the suction boxes so that the filter cloth can separate from the perforated plates as the filter cloth and conveyor continuously move and then separating the deposited sheet from the filter cloth; and continuously moving said conveyor so that said boxes are returned to the point at which said filter cloth comes into contact with said perforated plates of said suction boxes.

2. The process of claim 1, wherein the cementitious slurry and the fiber are uniformly fed onto the filter cloth across the direction of travel of said filter cloth by wide width cementitious slurry and fiber feeders.

3. The process of claim 1, wherein the surface of the green sheet of the fiber reinforced cement is pressed during or after excess water is removed by suction from the cementitious slurry.

4. The process of claim 3, wherein the surface of the green sheet of the fiber reinforced cement is pressed by a roll press.

5. The process of claim 1, wherein a first portion of cementitious slurry is fed onto said cloth and fiber is mixed with said slurry by beating said mixture followed by removing excess water by suction from said mixture and then feeding a second portion of said slurry onto said slurry-fiber mixture followed by removing excess water by suction from the deposited material.

6. A process for continuously preparing a fiber reinforced cement, which comprises: forming a conveyor by connecting a plurality of suction boxes each having a perforated plate and each having side wall members projecting above said perforated plate and continuously moving said conveyor; continuously moving a filter cloth at a synchronous speed with said conveyor into contact with said perforated plates immediately before a cementitious slurry is deposited on said filter cloth; continuously feeding said cementitious slurry containing solids in a ratio of water to solids ranging from 0.15 to 1:1 and glass fiber onto said filter cloth such that the slurry and fiber are mixed on the way to the filter cloth, said slurry and fiber being fed from feeders having a length substantially the same as the distance of the width of the suction boxes; confining the width of the deposited green sheet of cementitious material by the side wall members of each suction box, the uniformity of the mixture of fibers in cementitious slurry of the confined sheet being facilitated by the length of the feeders relative to the width of the suction boxes; removing excess water from said deposited sheet by applying suction to said suction boxes by a suction trough connected to a suction device; releasing the suction on the suction boxes so that the filter cloth can separate from the perforated plates as the filter cloth and conveyor continuously move and then separating the deposited sheet from the filter cloth; and continuously moving said conveyor so that said boxes are returned to the point at which said filter cloth comes into contact with said perforated plates of said suction boxes.

7. The process of claim 6, wherein the cementitious slurry and the fiber are uniformly fed onto the filter cloth across the direction of travel of said filter cloth by wide width cementitious slurry and fiber feeders.

8. The process of claim 6, wherein the surface of the green sheet of the fiber reinforced cement is pressed during or after excess water is removed by suction from the cementitious slurry.

9. The process of claim 8, wherein the surface of the green sheet of the fiber reinforced cement is pressed by a roll press.

* * * * *